US009822671B2

(12) United States Patent
Madin et al.

(10) Patent No.: US 9,822,671 B2
(45) Date of Patent: Nov. 21, 2017

(54) COMPOSITE HYBRID CAM CARRIER

(71) Applicant: Ford Global Technologies, LLC, Dearborn, MI (US)

(72) Inventors: Mark Michael Madin, Canton, MI (US); Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 107 days.

(21) Appl. No.: 15/058,843

(22) Filed: Mar. 2, 2016

(65) Prior Publication Data

US 2017/0254230 A1 Sep. 7, 2017

(51) Int. Cl.

| | |
|---|---|
| ***F01L 1/00*** | (2006.01) |
| ***F01L 1/053*** | (2006.01) |
| ***F02F 1/24*** | (2006.01) |
| ***F01L 1/46*** | (2006.01) |
| ***F01M 11/02*** | (2006.01) |
| *F01L 1/047* | (2006.01) |

(52) U.S. Cl.

CPC ..... *F01L 1/053* (2013.01); *F01L 1/46* (2013.01); *F01M 11/02* (2013.01); *F02F 1/24* (2013.01); *F01L 2001/0476* (2013.01); *F01L 2001/0537* (2013.01); *F01L 2101/00* (2013.01)

(58) Field of Classification Search

CPC .. F01L 1/053; F01L 1/0532; F01L 2001/0537
USPC ..... 123/90.27
See application file for complete search history.

(56) References Cited

U.S. PATENT DOCUMENTS

| | | | | |
|---|---|---|---|---|
| 4,848,292 | A | 7/1989 | Holtzberg | |
| 5,083,537 | A | 1/1992 | Onofrio et al. | |
| 5,228,418 | A | 7/1993 | Doehring | |
| 5,370,087 | A * | 12/1994 | Guimond | F02F 7/008 123/195 R |
| 5,375,569 | A | 12/1994 | Santella | |
| 5,435,281 | A * | 7/1995 | Regueiro | F01L 1/0532 123/193.3 |
| 5,540,553 | A | 7/1996 | Goto et al. | |

(Continued)

FOREIGN PATENT DOCUMENTS

| | | |
|---|---|---|
| CN | 201650491 U | 11/2010 |
| CN | 203097995 U | 7/2013 |
| GB | 2141783 B | 9/1986 |

OTHER PUBLICATIONS

AMPCO Metal SA, "AMPCO 18 Centrifugally Casted," http://www.ampcometal.com/products/aluminum-bronze/ampco-18-centrifugally-casted/, 2016 (2 pages).

(Continued)

*Primary Examiner* — Thomas Moulis
(74) *Attorney, Agent, or Firm* — Greg P. Brown; Price Heneveld LLP

(57) ABSTRACT

A cam carrier assembly includes a body made of a material lighter than aluminum. The body has a first side operably coupled with a cylinder head and a second side having bearing surfaces with bearing inserts. The bearing inserts support the camshaft. A series of apertures extend between the first and second sides of the body. Lobes of the camshaft operably couple with the valves of the cylinder head through the series of apertures extending between the first and second sides of the body.

20 Claims, 15 Drawing Sheets

(56) References Cited

U.S. PATENT DOCUMENTS

| | | | | |
|---|---|---|---|---|
| 5,651,337 | A * | 7/1997 | Regueiro | F01L 1/053 123/193.3 |
| 6,216,585 | B1 | 4/2001 | Chellappa | |
| 7,574,991 | B2 | 8/2009 | Kumagai et al. | |
| 2005/0252470 | A1* | 11/2005 | Malek | F01L 1/053 123/90.27 |
| 2006/0102110 | A1 | 5/2006 | Takenaka et al. | |
| 2006/0185471 | A1* | 8/2006 | Lawrence | F01L 1/047 74/595 |
| 2007/0240671 | A1* | 10/2007 | Imazato | F01L 1/053 123/193.5 |
| 2012/0073533 | A1* | 3/2012 | Hamada | F01L 1/053 123/90.27 |
| 2016/0177867 | A1* | 6/2016 | Wicks | F01M 9/10 123/90.38 |
| 2016/0177868 | A1* | 6/2016 | Wicks | F02F 7/006 123/90.6 |
| 2017/0016480 | A1* | 1/2017 | Rittmann | B32B 15/012 |

OTHER PUBLICATIONS

American Foundry Society (AFS), "Aluminum Metal Matrix Composites," http://www.afsinc.org/about/content.cfm?ItemNumber=6912, 109th Metalcasting Congress of the American Foundry Society (AFS), St. Louis, US, Apr. 16, 2005 (3 pages).

* cited by examiner

COMPOSITE HYBRID CAM CARRIER

STATEMENT REGARDING FEDERALLY SPONSORED RESEARCH AND DEVELOPMENT

This invention was made with government support under Award No. DE-EE0005574, awarded by the U.S. Department of Energy. The government has certain rights in the invention.

FIELD OF THE DISCLOSURE

The present concept generally relates to a cam carrier assembly that supports a camshaft to interface with engine valves. More specifically, the present disclosure relates to tappet bore inserts used in conjunction with bucket tappets in a cam carrier assembly.

BACKGROUND OF THE DISCLOSURE

Long lasting and durable engine components generally increase the longevity of automobiles. Improved automobile components that facilitate higher fuel efficiency are important as the demand for higher fuel efficiency vehicles increases.

SUMMARY OF THE DISCLOSURE

According to one aspect of the present disclosure, a cam carrier assembly includes a cylinder head having valves, a camshaft having lobes, and a cam carrier. The cam carrier is made of carbon fiber composite. The cam carrier has a first lower side that operably couples to the cylinder head and a second upper side with semi-circular lower bearing surfaces. Semi-circular bearing inserts operably couple with the semi-circular lower bearing surfaces to support the camshaft. A series of apertures extend between the first lower side and the second upper side of the cam carrier. One or more bucket tappets are disposed within the series of apertures that operably couple between the lobes of the camshaft and the valves of the cylinder head. One or more tappet bore inserts operably couple between the cam carrier and the bucket tappets within the series of apertures.

According to another aspect of the present disclosure, a cam carrier includes a single piece of carbon fiber composite that has a first lower side for engaging a cylinder head. The single piece of carbon fiber composite also has a second upper side with semi-circular lower bearing surfaces for supporting a camshaft. A series of apertures extend between the first lower side and the second upper side of the cam carrier in linear alignment with the semi-circular lower bearing surfaces for the camshaft to interface with valves on the cylinder head.

According to yet another aspect of the present disclosure, a cam carrier assembly includes a body made of a material lighter than aluminum. The body has a first lower side operably coupled with a cylinder head and a second upper side having semi-circular lower bearing surfaces with semi-circular bearing inserts. The semi-circular bearing inserts support the camshaft. A series of apertures extend between the first lower side and the second upper side of the body. Lobes of the camshaft operably couple with the valves of the cylinder head through the series of apertures extending between the first lower side and the second upper side of the body.

The carbon fiber cam carrier of the present disclosure decreases the weight of the cam carrier and valve train by 15%, providing a substantial weight reduction to an upper section of an associated engine. This weight reduction lowers the vehicle center of gravity among other advantages over metals typically used for cam carriers. Additionally, the tappet bore inserts and semi-circular lower bearing inserts reduce wear of the carbon fiber cam carrier and provide a surface that can be lubricated by oil films. The material used for manufacturing the tappet bore inserts can be machined to tight tolerances, which enables the use of the tappet bore inserts in confined spaces where precise control of component dimensions is beneficial. The surface characteristics of the tappet bore inserts and semi-circular lower bearing inserts can be controlled to promote even and full distribution of engine oil. The semi-circular lower bearing inserts and tappet bore inserts provide long term durability, serviceability, and improved lubricity when compared to the parent material of the cam carrier. Finally, the tappet bore inserts can be removed for service or replacement.

These and other aspects, objects, and features of the present disclosure will be understood and appreciated by those skilled in the art upon studying the following specification, claims, and appended drawings.

DETAILED DESCRIPTION OF THE EMBODIMENTS

Figure 1:
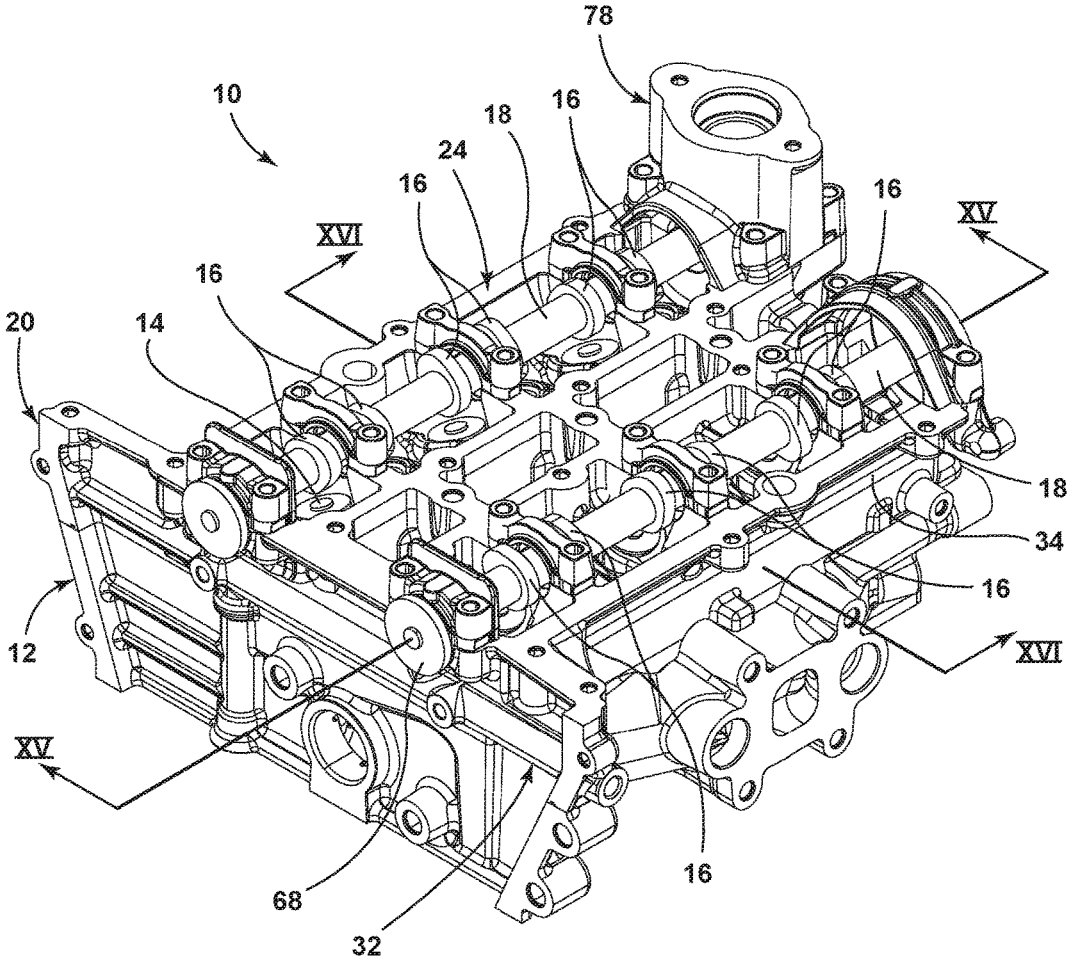
FIG. 1 is a top perspective view of a cam carrier assembly having a cam carrier attached to a cylinder head, according to one embodiment of the present disclosure.

For purposes of description herein, the terms "upper," "lower," "right," "left," "rear," "front," "vertical," "horizontal," and derivatives thereof shall relate to the concept as oriented in FIG. 1. However, it is to be understood that the concept may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-18, reference numeral 10 generally designates a cam carrier assembly that includes a cylinder head 12 having a series of engine valves 14 that interface with one or more cam lobes 16 of a camshaft 18. A cam carrier 20 of the cam carrier assembly 10 includes a first lower side 22 coupled with the cylinder head 12 in sealed engagement around the valves 14. A second upper side 24 of the cam carrier 20 has semi-circular lower bearing surfaces 26 and semi-circular bearing inserts 28 that support the camshaft 18. A series of apertures 30 extend between the first lower side 22 and the second upper side 24 of the cam carrier 20 for the cam lobes 16 of the camshaft 18 to interface with the series of engine valves 14 and operate the associated engine in according with the overall engine requirements for a vehicle. It is however, contemplated that the cam carrier assembly 10 may also be applied to engines not used in conjunction with a vehicle. The cam carrier 20 of the present disclosure is made of carbon fiber composite. The carbon fiber composite can be configured to provide thermal insulation of the camshaft 18 from the cylinder head 12 and provide a substantial weight reduction to an upper section of an associated engine.

Referring now to the embodiment illustrated in FIG. 1, the cam carrier assembly 10 is shown with the cam carrier 20 attached to an upper portion 32 of the cylinder head 12 for enclosing the engine valves 14 and positioning the camshaft 18 and associated cam lobes 16 in alignment to interface with the engine valves 14. The cam carrier 20 and the cylinder head 12 have thermal expansion properties. The thermal expansion properties of the cam carrier 20 and the cylinder head 12 can differ by at least 25%. It is contemplated that the upper portion 32 of the cylinder head 12 may include rocker arms, intake and exhaust valves, valve springs, and other conceivable components that may be concealed by the cam carrier 20. Although referenced herein as the upper portion 32 of the cylinder head 12, it is understood that additional embodiments of the cylinder head 12 may be alternatively oriented or rotated, such as in a boxer-style engine, to position the valves on a lower or side portion of the cylinder head 12.

As also shown in the embodiment depicted in FIG. 1, a lower peripheral edge 34 of the first lower side 22 (FIG. 2) of the cam carrier 20 is generally fixedly attached around the upper portion 32 of the cylinder head 12 to form a liquid seal for preventing fluid from leaking there between. In one embodiment, the liquid seal can be formed by a gasket 36 (FIG. 15) attached around the peripheral edge 34 and compressed between the cylinder head 12 and the cam carrier 20. It is also contemplated that the liquid seal may be formed by other materials, such as liquid gaskets, that may be disposed there between to provide a seal that prevents liquid and gases from escaping.

Figure 2:
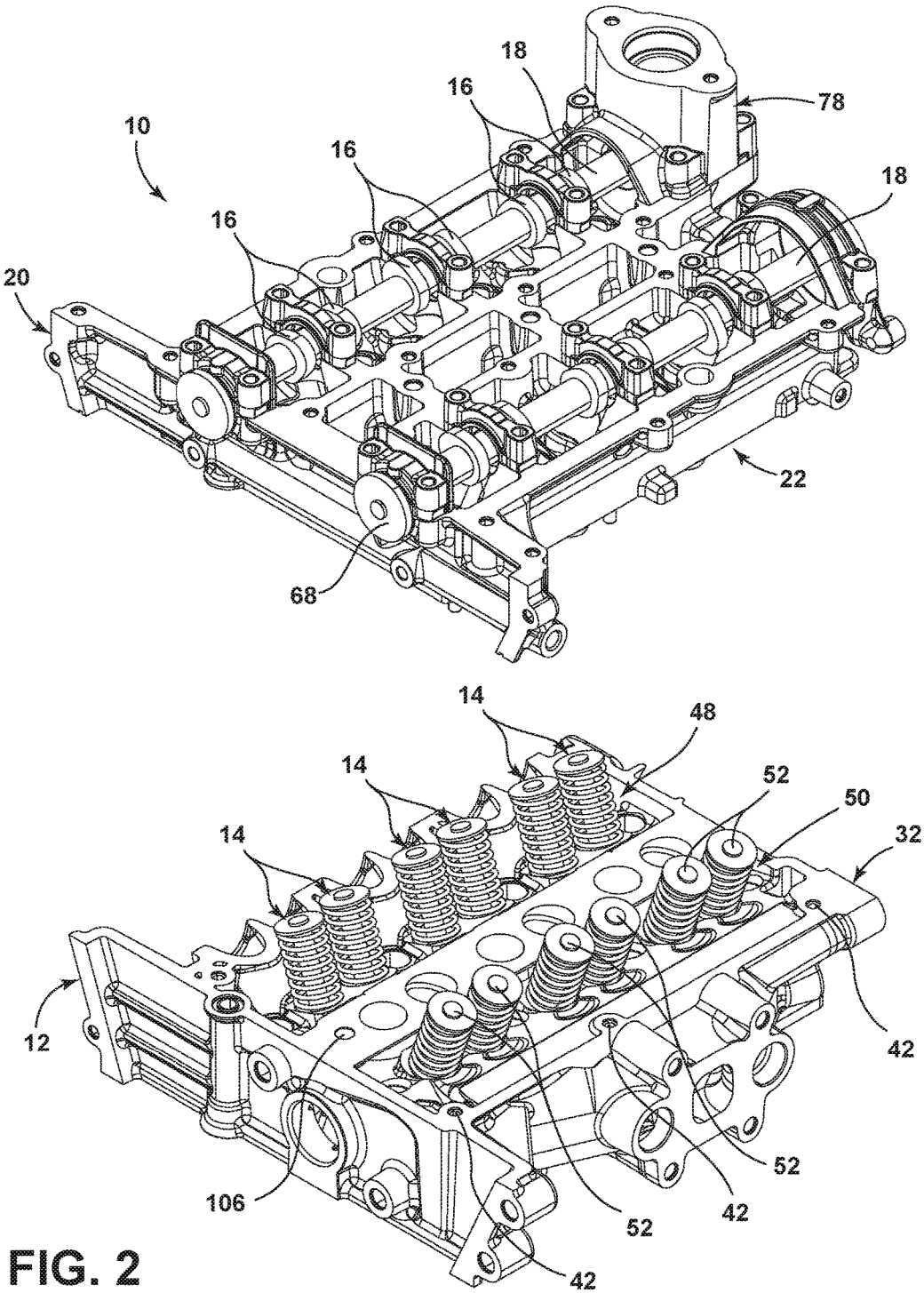
FIG. 2 is a partially exploded top perspective view of the cam carrier assembly shown in FIG. 1, illustrating the cam carrier exploded away from the cylinder head.

With reference to FIG. 2, the illustrated embodiment of the cam carrier 20 also includes mounting holes 38 (FIG. 11) inward from the peripheral edge 34 extending between the first lower side 22 and the second upper side 24 to allow one or more threaded fasteners 40 (FIG. 16) to extend through the cam carrier 20 and into threaded engagement with corresponding fastening holes 42 on the cylinder head 12, thereby securing the cam carrier 20 to the cylinder head 12. The mounting holes 38 are aligned with the fastening holes 42 to allow cylindrically shaped shanks 44 of the threaded fasteners 40 (FIG. 16) to pass through the mounting holes 38 and engage the threaded fastening holes 42. The material of the cam carrier 20 surrounding the mounting holes 38 is sized with sufficient mass to allow a head portion 46 of the threaded fasteners 40 (FIG. 16) to abut and compress the cam carrier 20 proximate the mounting holes 38 and form the fluid seal between the cam carrier 20 and the cylinder head 12. In additional embodiments, it is appreciated that the mounting holes 38 may be alternatively shaped and arranged on the cam carrier 20, such as outside the gasket 36 along the peripheral edge 34. It is also contemplated that the threaded fasteners 40 may include bolts, screws, or other conceivable fasteners or attachment features that will withstand operating conditions of the engine.

Figure 17:
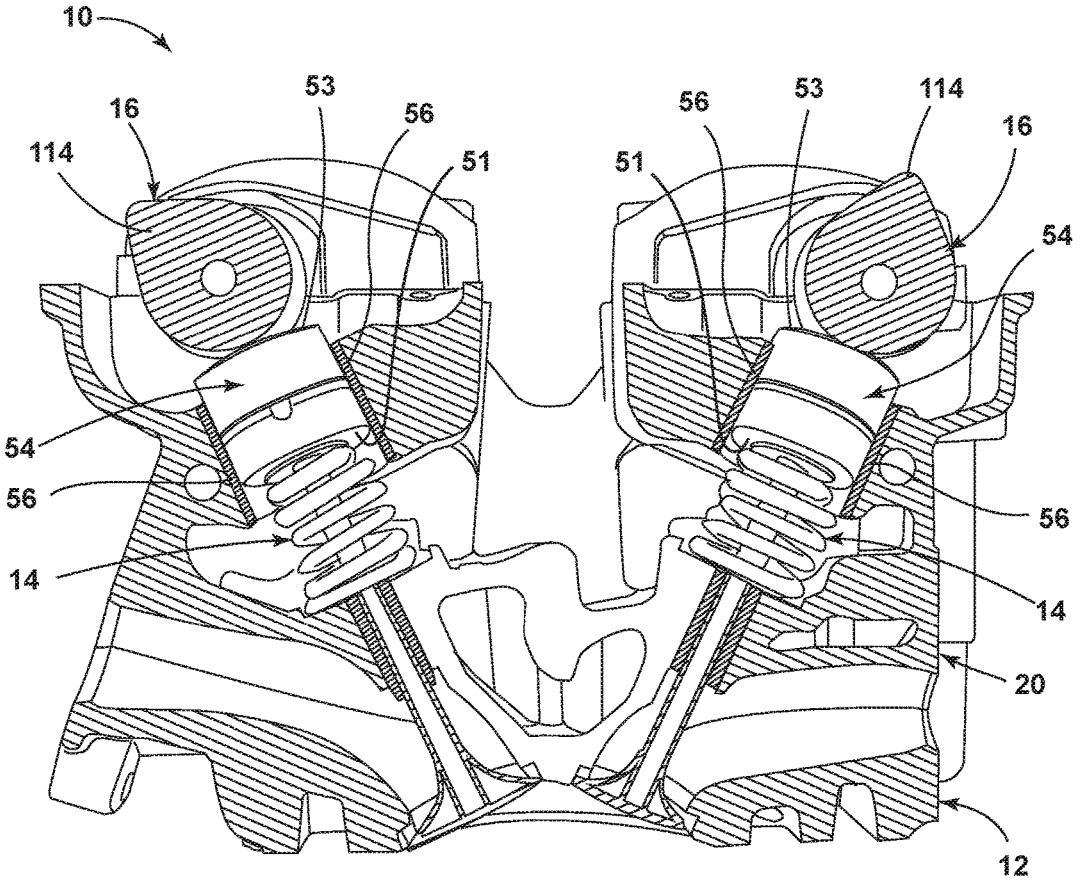
FIG. 17 is a cross-sectional view of a cam carrier assembly showing an additional embodiment of the present disclosure.

As further illustrated in FIG. 2, the cam carrier 20 is shown detached from the cylinder head 12 to expose the engine valves 14 on the upper portion 32 of the cylinder head 12. The illustrated embodiment of the cylinder head 12 includes an intake row 48 and an exhaust row 50 of the engine valves 14, whereby each piston cylinder has two valves from the intake row 48 and two valves from the exhaust row 50. It is conceivable that in an additional embodiment, there may be more or fewer valves 14 on the cylinder head 12 and the valves 14 may be alternatively arranged, configured, and otherwise dedicated to piston cylinders from that of the illustrated embodiment. The valves 14 on the illustrated cylinder head 12 are aligned with the linear series of apertures 30 (FIG. 13) extending between the first lower side 22 and the second upper side 24 of the cam carrier 20 for the lobes 16 of the camshaft 18 to interface with the valves 14 on the cylinder head 12. Specifically, the illustrated embodiment has two camshafts 18, one camshaft 18 for the intake row 48 and one camshaft 18 for the exhaust row 50 of valves 14 with a lobe 16 on the camshafts 18 for each valve 14. Accordingly, the valves 14 extend upward in the apertures 30 in the cam carrier 20 and are provided with distal end surfaces 52 that directly abut a lower or inside surface 51 of a bucket tappet 54. An upper or outside surface 53 of the bucket tappet 54 operably couples to the lobes 16 of the camshaft 18. It is conceivable that the valves 14 can be actuated by rocker arms with or without rollers or bucket tappets 54. The bucket tappets 54 can be hydraulic buckets, as shown in FIG. 17, or direct-acting mechanical buckets. When bucket tappets 54 are used, tappet bore inserts 56 may be disposed between the bucket tappets 54 and the cam carrier 20 within the series of apertures 30 of the cam carrier 20. In an additional embodiment the valves 14 can be otherwise configured to interface with the lobes 16 of the camshaft 18.

Figure 3:
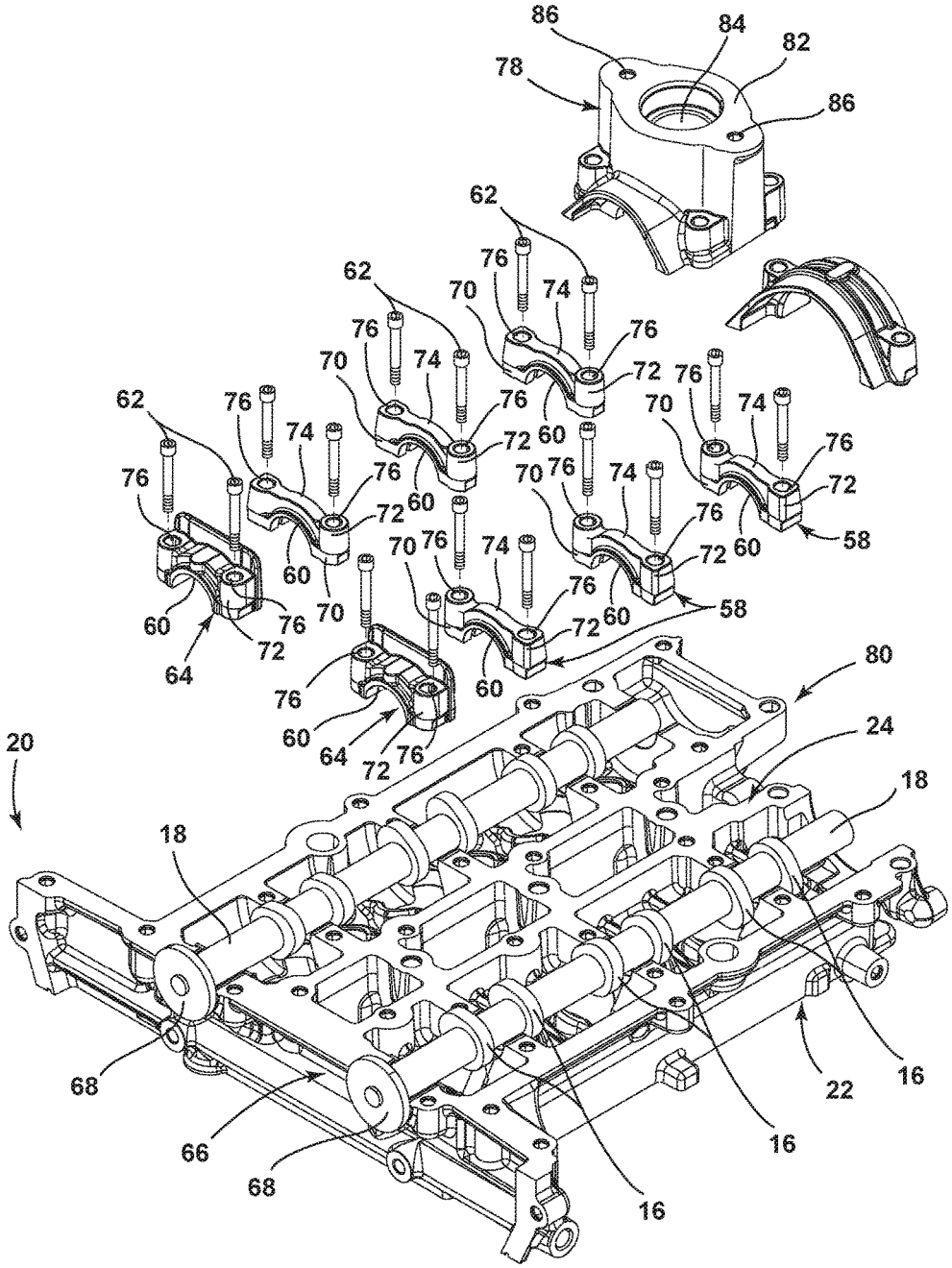
FIG. 3 is a partially exploded top perspective view of the cam carrier assembly shown in FIG. 1, illustrating cam caps and a fuel pump pedestal exploded away from the cam carrier.
Figure 4:
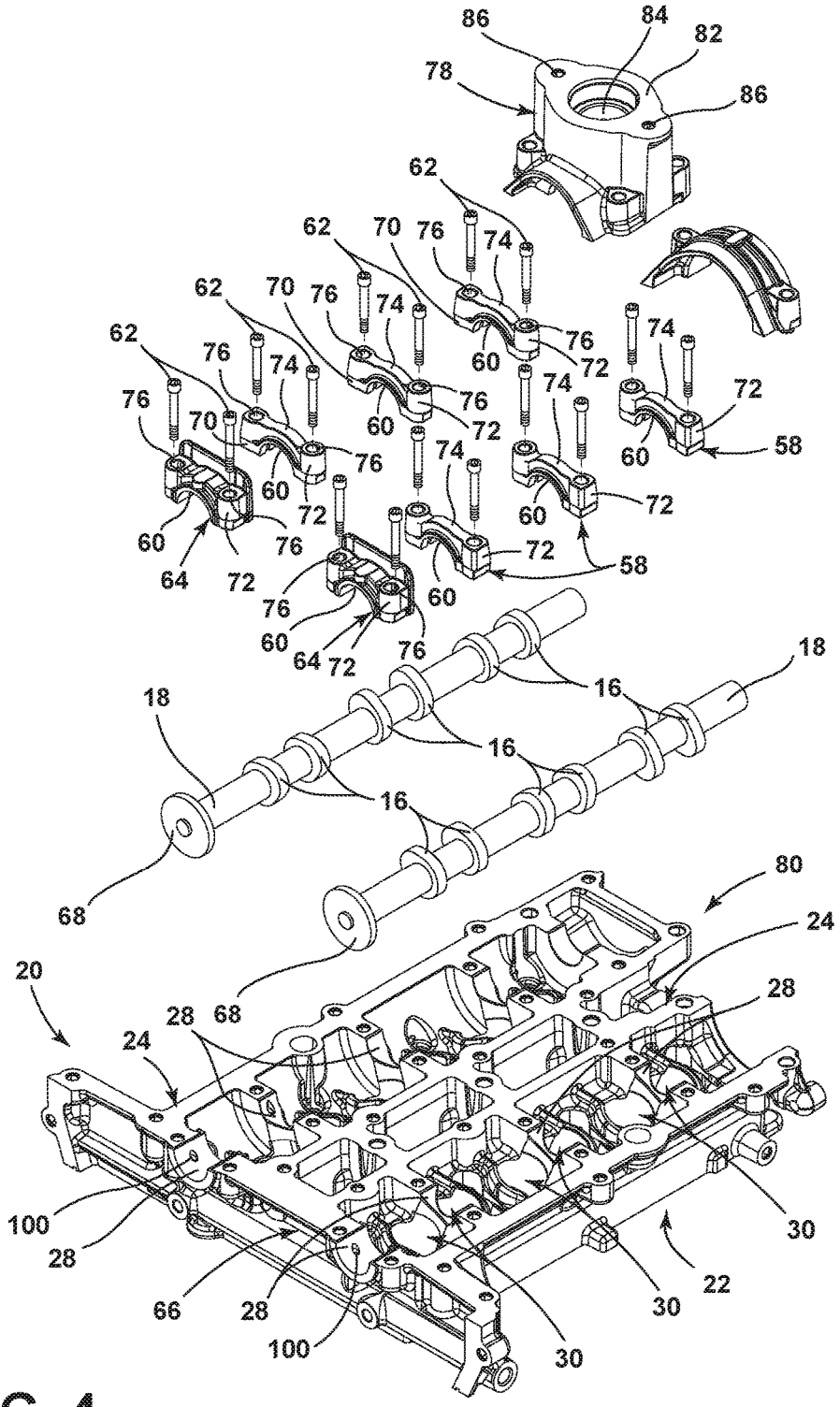
FIG. 4 is a partially exploded top perspective view of the cam carrier assembly.
Figure 5:
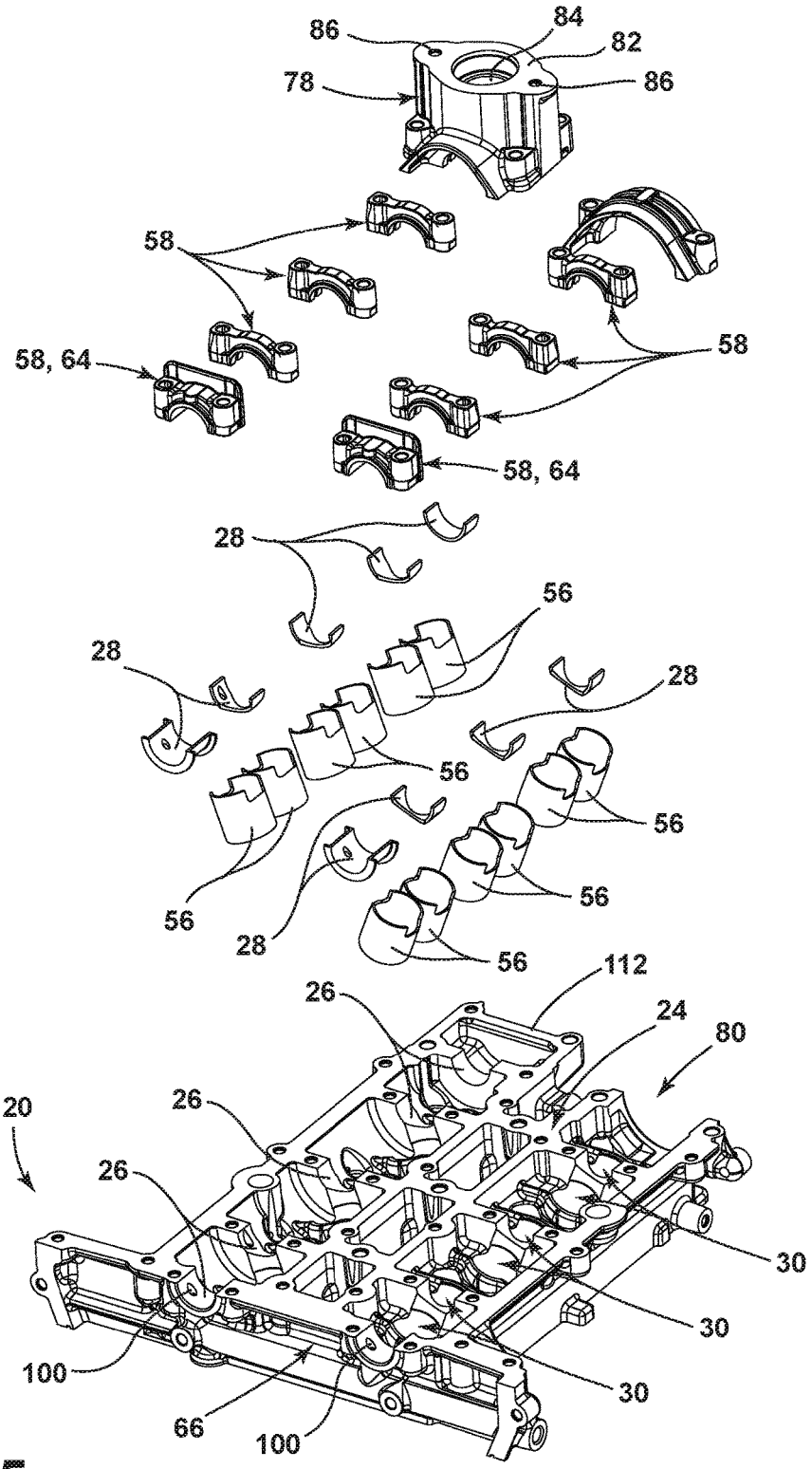
FIG. 5 is a partially exploded top perspective view of the cam carrier shown in FIG. 4, illustrating the tappet bore inserts and semi-circular bearing inserts exploded away from the cam carrier.
Figure 6:
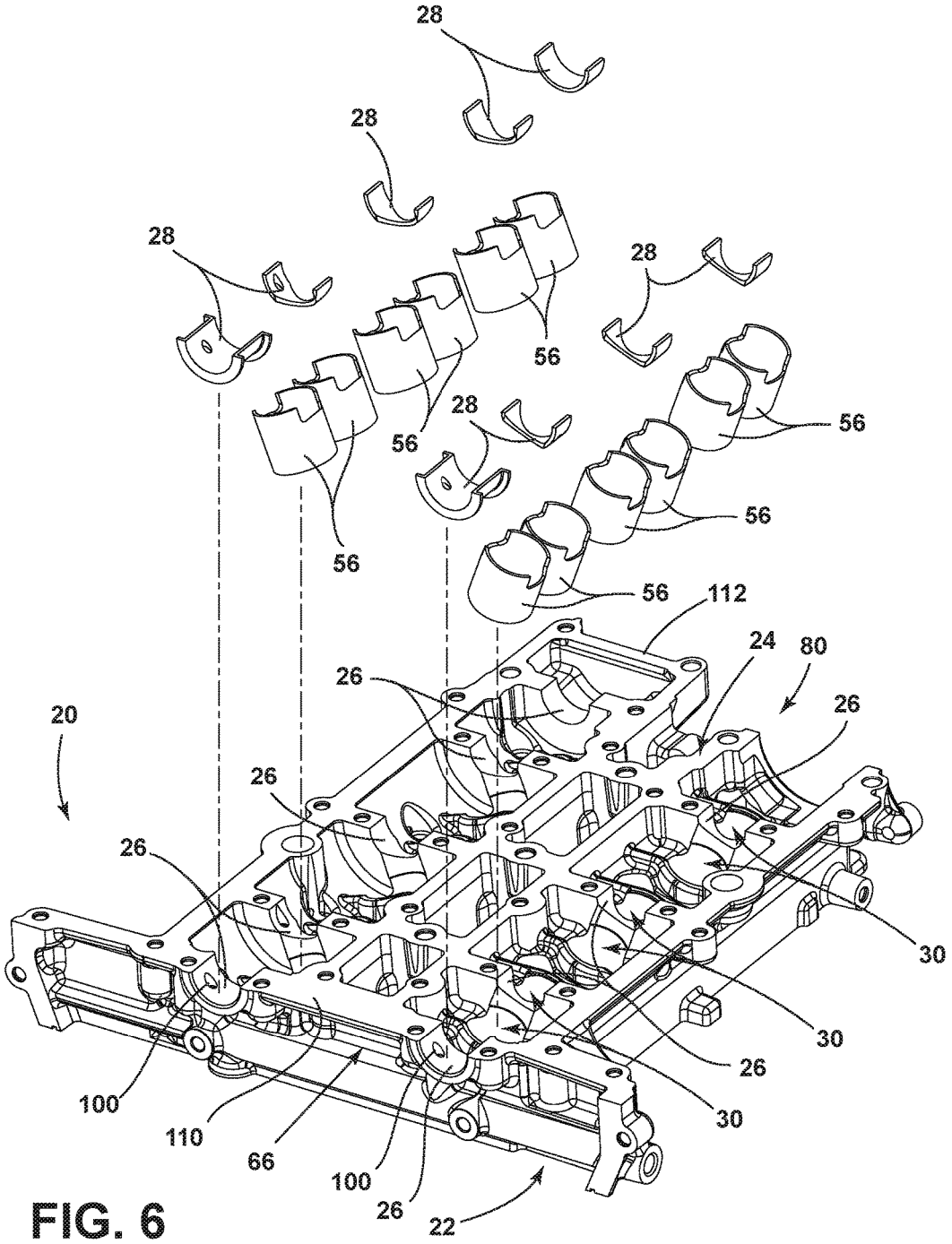
FIG. 6 is a partially exploded top perspective view of the cam carrier shown in FIG. 4.

Referring now to FIG. 3, the cam carrier 20 is illustrated separate from the cylinder head 12 (FIG. 2) with one or more cam caps 58 exploded away from the second upper side 24 of the cam carrier, each having a semi-circular upper bearing surface 60 for directly engaging the camshaft 18 and supporting rotation thereof. The cam caps 58 are coupled with the second upper side 24 of the cam carrier 20, each on opposing sides of the camshaft 18, such that the semi-circular upper bearing surfaces 60 arch over the respective camshaft 18 and provide upper support to the camshaft 18. In the illustrated embodiment, the cam caps 58 are separately formed from the cam carrier 20 and each of the cam caps 58 are fastened to the second upper side 24 of the cam carrier 20 with one or more fasteners 62 that engage the cam carrier 20 on opposing sides of each camshaft 18. As shown, each camshaft 18 includes four cam caps 58 that secure the camshaft 18 against the semi-circular bearing inserts 28 of the cam carrier 20. End caps 64 of the cam caps 58 are attached at a first end 66 of the cam carrier 20 to allow an exterior disk 68 on the camshaft 18 to rotate outside the cam carrier 20. The cam caps 58 as shown include one or more cam cap inserts 70 that defines the semi-circular upper bearing surface 60. Arm portions 72 extend outward from ends of the semi-circular upper bearing surfaces 60 to abut the cam carrier 20 around the fasteners 62 used to attach the cam caps 58. The semi-circular bearing inserts 28 can be a metal material, such as a steel alloy, a copper alloy, an aluminum alloy, and other conceivable metals or combinations or layers thereof, and may include a layer of babbitt material or other surface plating or coating to improve and further define the semi-circular lower bearing surface 26. An upper piece 74 of the cam caps 58 attaches over the cam cap inserts 70 and defines mounting bosses on opposing sides of the camshaft 18 with fastener apertures 76 extending vertically therein to receive the fasteners 62 that secure the cam caps 58 to the cam carrier 20. It is conceivable that the upper piece 74 of the cam caps 58 may include a polymer material and/or may be a uniform material with the cam cap inserts 70, such as a metal alloy or composite material.

As also shown in FIGS. 3-7, a fuel pump pedestal 78 is coupled with the second upper side 24 of the cam carrier 20 proximate a second end 80 thereof over one of the camshafts 18. The fuel pump pedestal 78 is configured for supporting a fuel pump on a top surface 82 thereof. The fuel pump pedestal 78 in the illustrated embodiment is formed separately from the cam carrier 20 and is fastened to the second upper side 24 of the cam carrier 20 with threaded fasteners. The top surface 82 of the fuel pump pedestal 78 is generally planar and spans over the vertically protruding fuel pump pedestal 78 with a hole 84 extending downward in a central area and two smaller attachment apertures 86 on opposing sides of the hole 84. The attachment apertures 86 are configured to receive fasteners for securing a fuel pump to the planar top surface 82 of the fuel pump pedestal 78. Additional embodiments may have the fuel pump pedestal 78 alternatively configured or positioned on the cam carrier 20 and may have the fuel pump pedestal 78 integrally formed with the cam carrier 20 or portions thereof With reference to FIGS. 10-12, the cam carrier 20 is illustrated without the camshafts 18 to show how the cam carrier 20 is substantially divided into two separate longitudinal cam housings 88, one for each camshaft 18. The cam housings 88 extend in parallel relationship to each other and in alignment with a rotational axis of the associated camshaft 18. The longitudinal cam housings 88 are interconnected with reinforcement members 90 that are formed integrally with the overall cam carrier 20. The reinforcement members 90, in the illustrated embodiment, extend orthogonally between the longitudinal cam housings 88 and each include mounting apertures 92 to receive fasteners for attaching at least one fuel rail that extends in general parallel alignment with the camshafts 18, as generally understood in the art. Interior edges of the longitudinal cam housings 88 proximate the reinforcement members 90 include cover mounting apertures 92 for mounting fasteners that secure a cam cover over the second upper side 24 of the cam carrier 20 to enclose the camshafts 18. It is contemplated that additional embodiments may include a single camshaft or camshafts spaced apart far enough to necessitate separate cam carriers that have a single longitudinal cam housing. Further, it is conceivable that alternative embodiments may have more or alternatively arranged camshafts wherein additional longitudinal cam housings or a differently configured cam carrier would be desired.

Figure 11:
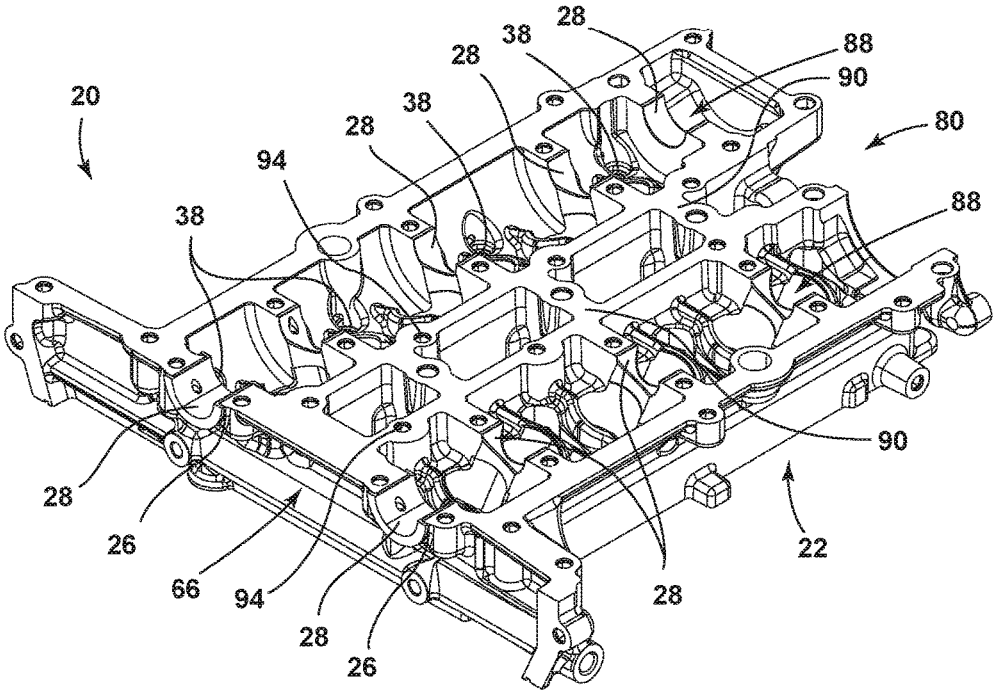
FIG. 11 is a top perspective view of the cam carrier taken from a first end.
Figure 12:
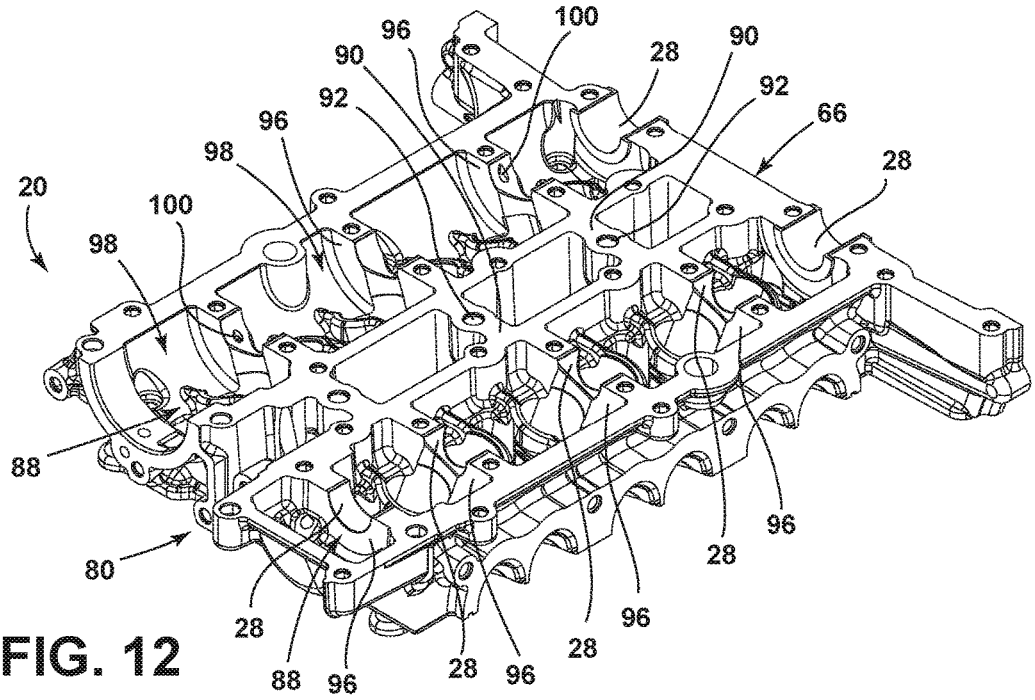
FIG. 12 is a top perspective view of the cam carrier taken from a second end.
Figure 13:
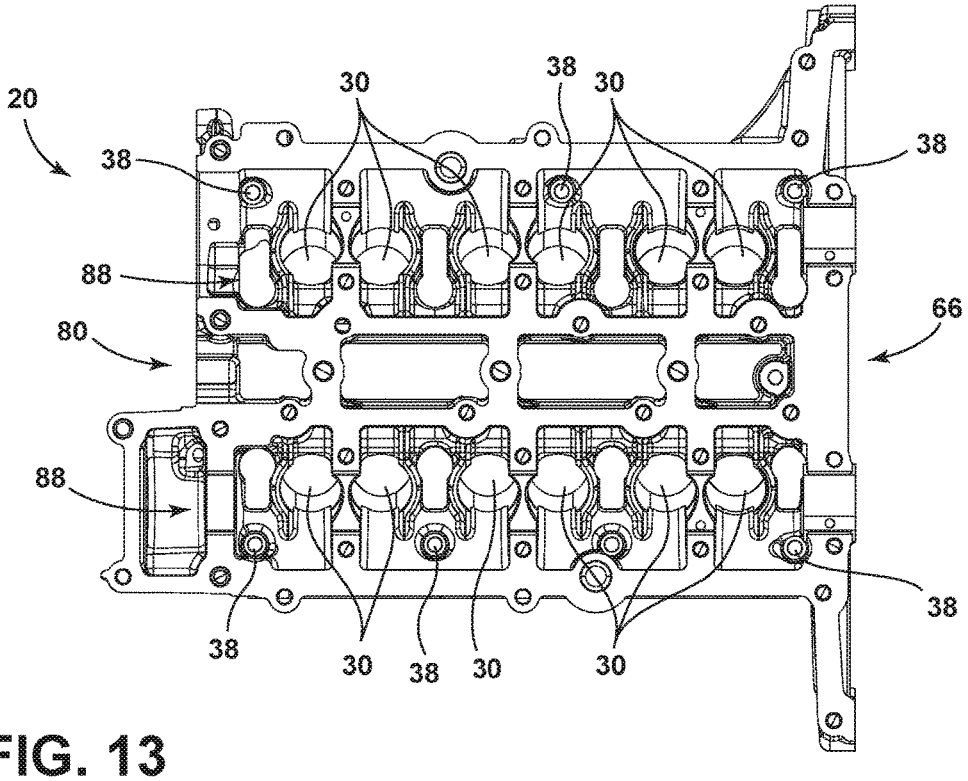
FIG. 13 is a top plan view of the cam carrier.

As further illustrated in FIGS. 11-13, each of the longitudinal cam housings 88 includes a series of vertical walls 96 of cam towers that separate and define a series of cavities 98 on the second upper side 24 of the cam carrier 20. The series of cavities 98 are sufficiently sized to each include an area that surrounds the cam lobes 16 of the camshaft 18 and permits rotation therein. To effectuate rotation, the series of vertical walls 96 have the semi-circular lower bearing surfaces 26 formed therein and aligned for supporting the associated camshaft 18. The illustrated semi-circular lower bearing surfaces 26 formed in the cam carrier 20 have a narrowed thickness in the vertical walls 96 proximate the lowest point of the semi-circular lower bearing surface 26, which gradually narrows toward the lowest point. Between the vertical walls 96, within the cavities 98, the series of apertures 30 extend between the first lower side 22 and the second upper side 24 in alignment with the camshaft 18 for the lobes 16 of the camshaft 18 to interface with the valves 14 on the cylinder head 12. Accordingly, the series of apertures 30 are arranged in linear alignment with the semi-circular lower bearing surfaces 26 for the camshaft 18 to be positioned over the series of cavities 98 and interface with the valves 14 extending through the series of apertures 30.

Still referring to FIGS. 11-13, the vertical walls 96 are shown to include outlet apertures 100 for oil feed channels formed integrally within the cam carrier 20, such that lubrication may traverse the oil feed channels and be dispensed from the outlet apertures 100 to a circumference of the semi-circular lower bearing surfaces 26, thereby lubricating the camshaft 18 for rotation on the semi-circular bearing inserts 28. In this embodiment, the oil feed channels align with and connect to corresponding channels in the cylinder head 12 (FIG. 2) to receive the flow of lubricating oil. However, it is contemplated that in additional embodiments, the oil feed channels may extend from alternative surfaces or locations on the cam carrier 20 and the oil feed channels may enter the cam bearings at different locations.

Figure 14:
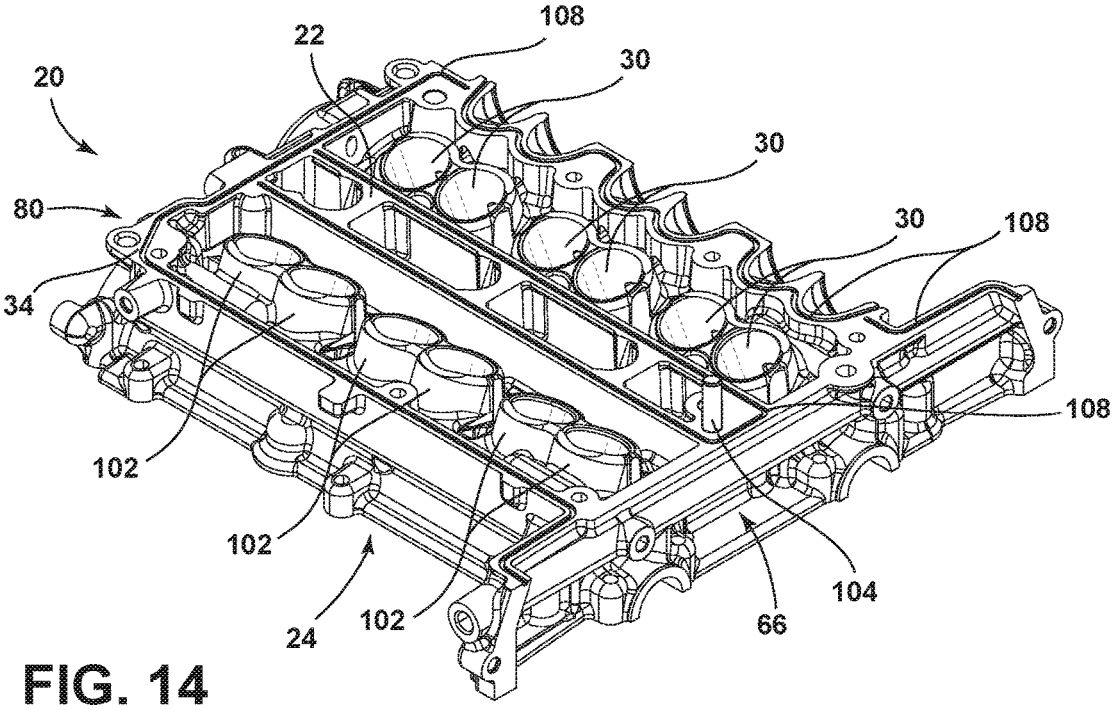
FIG. 14 is a bottom perspective view of the cam carrier.

As illustrated in FIGS. 13-14, the series of apertures 30 are cylindrically shaped and angled vertically inward toward the opposing cam housing 88 for the corresponding valves 14 (FIG. 16) to engage a piston cylinder centrally between the longitudinal cam housings 88. The first lower side 22 of the cam carrier 20 includes tubular projections 102 that each surrounds one of the apertures 30 of the series of apertures 30. The tubular projections 102 are arranged in interconnected pairs that are each designated for a single piston cylinder. The first lower side 22 of the cam carrier 20, as illustrated, includes a locating member 104 protruding downward for engaging a corresponding locating aperture 106 on the cylinder head 12 (FIG. 2), for aligning the cam carrier 20 on the cylinder head 12 and thereby aligning the camshaft 18 with the valves 14. It is contemplated that the first lower side 22 of the cam carrier 20 in additional embodiments may include a locating aperture 106 that engages a corresponding locating member 104 on the cylinder head 12, and is also conceivable that various arrangements and combinations of locating members 104 and locating apertures 106 may be incorporated between the cam carrier 20 and the cylinder head 12 to provide proper alignment.

As further illustrated in FIGS. 13-14, the first lower side 22 of the cam carrier 20 may include a gasket channel 108 substantially surrounding the series of apertures 30 on each longitudinal cam housing 88 for a gasket 36 (FIG. 15) to attach therein. The gasket channel 108 is formed on the peripheral edge 34 of the first lower side 22 of the cam carrier 20 for consistently abutting the upper portion 32 of the cylinder head 12 around the valves 14. The gasket 36 may be provided in the gasket channel 108 to provide sealed engagement of the cam carrier 20 to the cylinder head 12, preventing leakage of fluids and gases there between.

Figure 10:
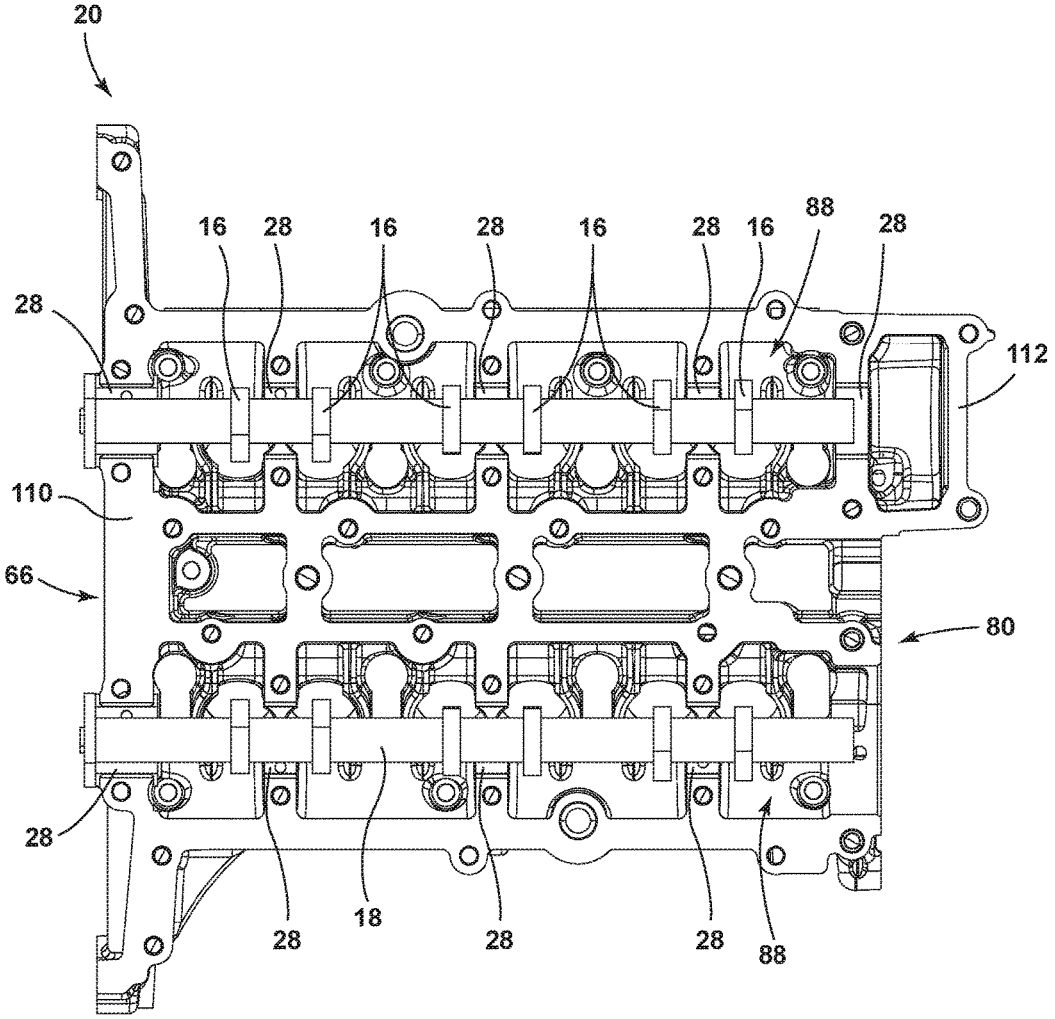
FIG. 10 is a top plan view of the cam carrier having camshafts assembled therewith.
Figure 15:
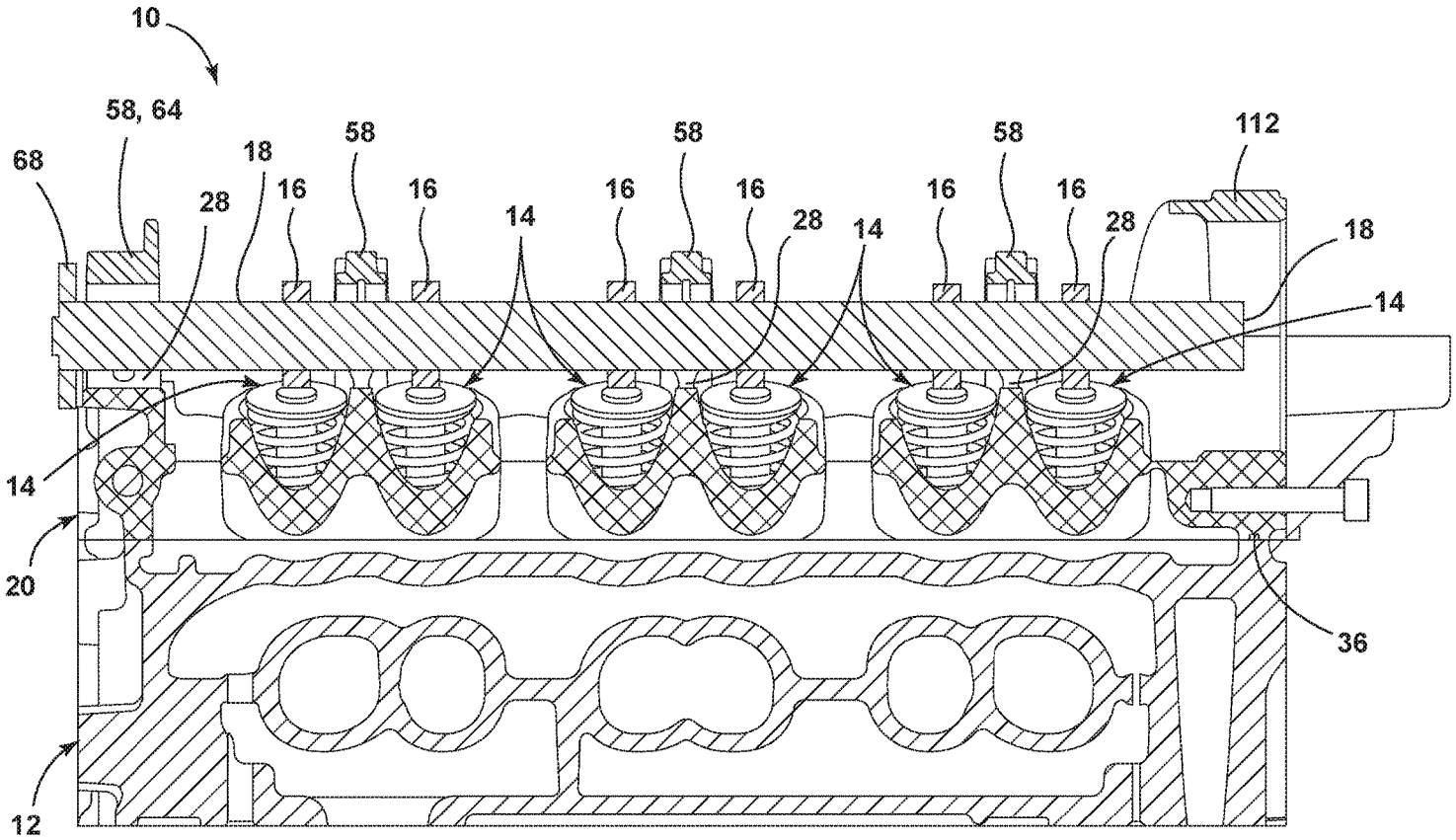
FIG. 15 is a cross-sectional view of the cam carrier assembly taken at line XV-XV of FIG. 1.

Referring to FIGS. 10 and 15, a first end wall 110 of the cam carrier 20, proximate the first end 66 of each of the longitudinal cam housings 88 includes one of the semi-circular lower bearing surfaces 26 for the respective camshaft 18 to protrude through the first end wall 110 out of the cam carrier 20 for engaging a timing mechanism, such as a belt or chain, as generally understood by one of ordinary skill. However, an opposing second end wall 112 of the cam carrier 20, proximate the second end 80 of the longitudinal cam housings 88, does not include an aperture for the camshaft 18 to exit the cam carrier 20, thereby substantially enclosing the corresponding end portions of the camshafts 18. As also shown in the illustrated embodiment, the cam carrier 20 is attached in directly abutting contact with the cylinder head 12 (FIG. 2) and the camshaft 18 is supported in direct contact with the semi-circular bearing inserts 28 of the cam carrier 20, providing a barrier between the cam carrier 20 and the camshaft 18.

Figure 16:
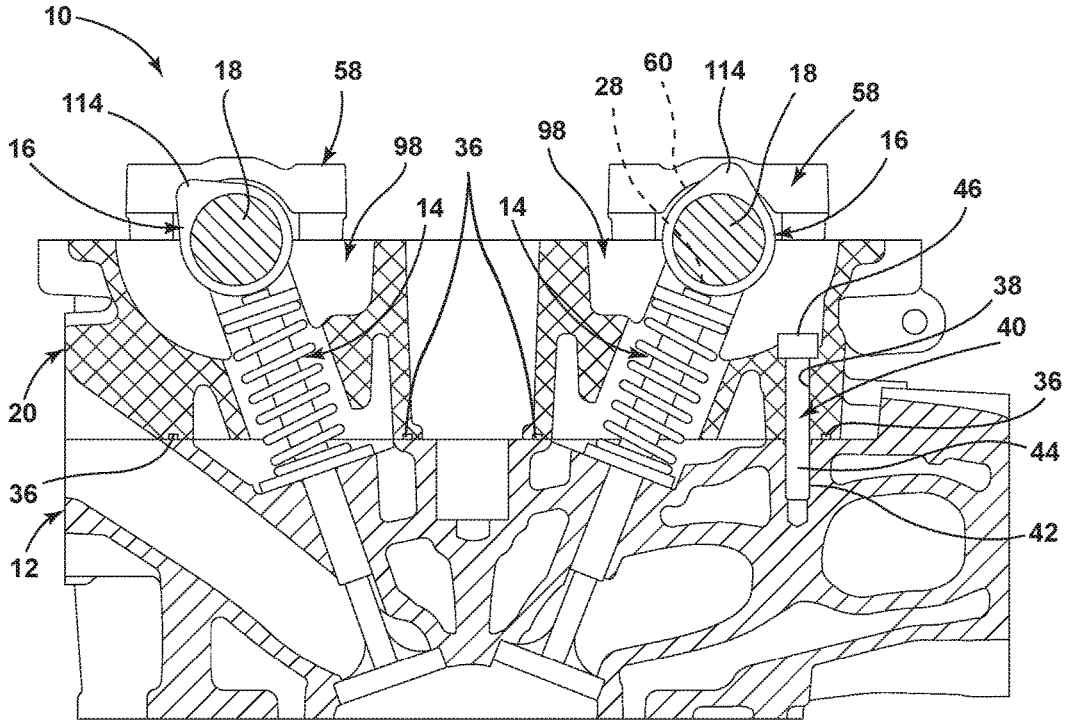
FIG. 16 is a cross-sectional view of the cam carrier assembly taken at line XVI-XVI of FIG. 1.

As depicted in FIG. 16, the semi-circular upper bearing surfaces 60 of the cam caps 58 together with the semi-circular bearing inserts 28 on the second upper side 24 of the cam carrier 20 define cam bearings that surround the circumference of the camshaft 18. The illustrated bearings have two equal halves of the total circumference of the cam bearing defined by the semi-circular bearing insert 28 on the cam carrier 20 and the semi-circular upper bearing surface 60 on the cam caps 58. Within the cavities 98 on the second upper side 24 of the cam carrier 20, the head mounting holes 38 extend downward to align with the fastening holes 42 in the cylinder head 12. The head portion 46 of the fastener 62 abuts the second upper side 24 of the cam carrier 20 and a cylindrically shaped shank 44 of the fastener 62 threadably engages the cylinder head 12. The cam carrier 20 is compressed between the head portion 46 of the fastener 62 and the cylinder head 12, forming a fluid seal along the peripheral edge 34 proximate the gasket 36 between the cylinder head 12 and the cam carrier 20. The lobes 16 of the camshaft 18 are also illustrated to include a nose 114 that abuts the distal end surfaces 52 of one of the valves 14 to actuate and open the valve 14, displacing the valve stem downward and moving the head of the valve 14 away from the valve seat insert on a lower portion of the cylinder head 12, as generally understood in the art. Alternatively, the nose 114 of the lobes 16 of the camshaft 18 can abut the bucket tappets 54 to actuate and open the valve 14, displacing the valve stem downward and moving the head of the valve 14 away from the valve seat insert on a lower portion of the cylinder head 12.

With respect to the carbon fiber composite material used to integrally form the cam carrier 20 as a single unit, it is contemplated that various methods of carbon fiber construction may be used, including injection molding a thermosetting resin with chopped carbon fiber particles. Alternatively, strands of graphite or fiberglass particles can be used in the carbon fiber composite material. It is also conceivable that portions or the entire cam carrier 20 may be made with different carbon fiber constructions, such as wound filament or layered sheets. The carbon fiber composite may also include additional reinforcing fibers, such as aramid or glass fibers, and may have various compositions of resin or graphite materials to form the composite structure. Despite the construction, the illustrated embodiment of the cam carrier 20 has both a first lower side 22 and a second upper side 24 with surfaces defined by carbon fiber composite material. Further, the illustrated embodiment of the cam carrier 20 has the semi-circular lower bearing surfaces 26 defined by carbon fiber composite material. The semi-circular bearing inserts 28 are operably coupled to the semi-circular lower bearing surfaces 26 to reduce wear to the carbon fiber composite. It is contemplated that the semi-circular lower bearing surfaces 26 can be engineered to withstand the friction of the rotating camshaft 18; thereby eliminating the bearing inserts 28. It is contemplated that such engineering may include having strands of carbon fiber wound around in the direction of the circumference of camshaft 18 to provide the bearing surface 26 with fewer surface irregularities. Furthermore, it is contemplated that the semi-circular lower bearing surfaces 26 can have coatings over the carbon fiber composite to provide the semi-circular lower bearing surfaces 26 with fewer surface irregularities and reduce friction between the camshaft 18 and the semi-circular lower bearing surfaces 26. With respect to the material used to form the cylinder head 12, the illustrated embodiment of the cylinder head 12 is made of an aluminum alloy. However, it is contemplated that additional or alternative alloys or metals, such as magnesium, may be used to form the cylinder head 12 or individual portions thereof.

With reference again to FIG. 4, the method of assembling the camshafts 18 to the cam carrier 20 is generally shown, whereby the camshafts 18 and lobes 16 are preassembled or otherwise formed. After providing any surface lubrication or coatings to the camshaft 18 and/or the semi-circular bearing inserts 28, the camshafts 18 are placed on the cam carrier 20 along the semi-circular bearing inserts 28 on the second upper side 24 of the cam carrier 20. The length-wise position of the camshaft 18 is then adjusted to align the lobes 16 with the apertures 30 in the cam carrier 20 and the associated valves 14 (FIG. 16) that can protrude therein from the cylinder head 12. Upon aligning the lobes 16, the cam caps 58 are placed over the camshaft 18 at multiple positions along the length of the camshafts 18. The fasteners 62 for the cam caps 58 are then driven through the cam caps 58 and into the cam carrier 20 for securing the camshafts 18 to the cam carrier 20 and preventing upward displacement of the camshaft 18 during operation of the engine. Further, either before or after installation of the cam caps 58, the fuel pump pedestal 78 is attached to the second end 80 of the cam carrier 20 with fasteners similar to the cam caps 58.

Figure 18:
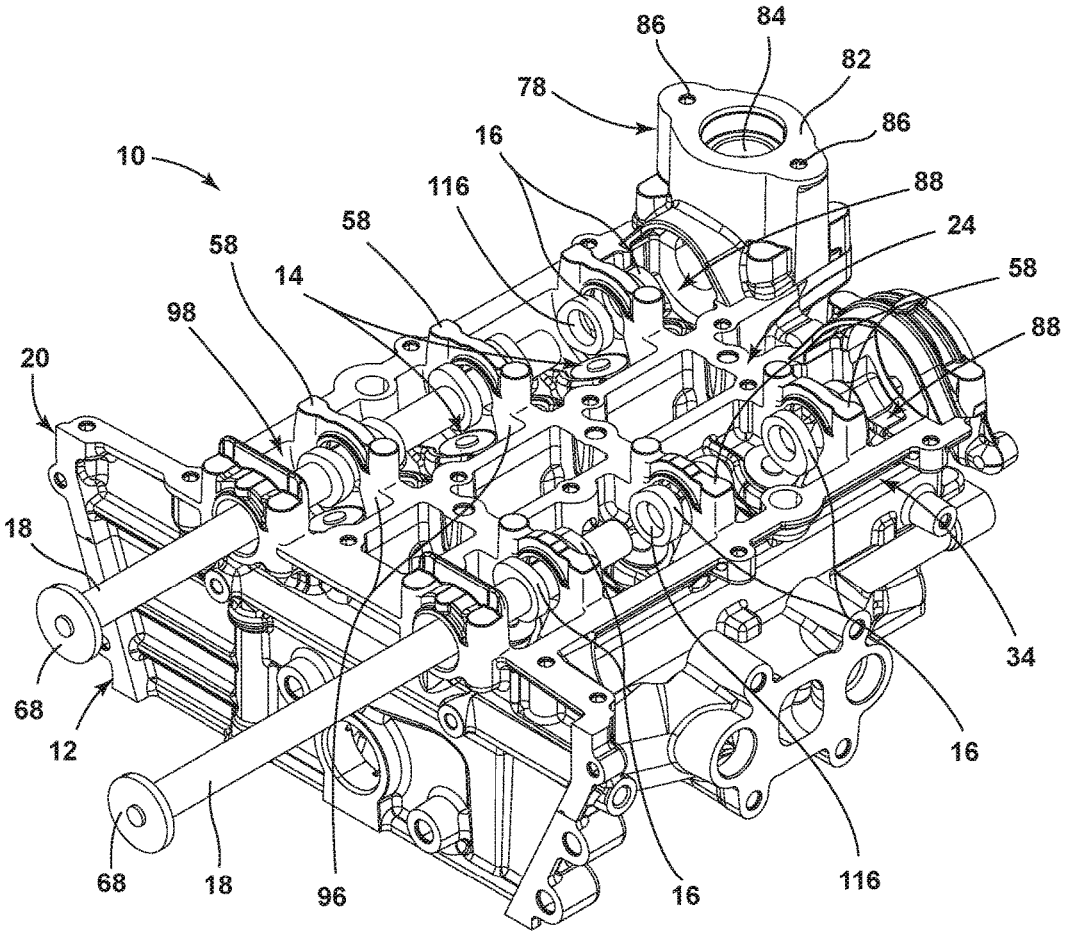
FIG. 18 is an exploded top perspective view of an additional embodiment of the cam carrier assembly, illustrating an assembly method for the associated camshafts.

An additional embodiment of the cam carrier 20 is illustrated in FIG. 18, along with the associated method of assembling the camshafts 18 to such a cam carrier 20. In this embodiment of the cam carrier 20, each of the cam caps 58 are formed integrally with the cam carrier 20 and thereby protrude upward from the second upper side 24, such that the semi-circular upper bearing surfaces 60 of the cam caps 58 are an integral surface with the semi-circular lower bearing surfaces 26 of the cam carrier 20, together defining a circular bearing that operably engages the camshaft 18. According to such an embodiment, prior to mounting the cam carrier 20 on the cylinder head 12, the cam carrier 20 may be assembled with a camshaft 18 and one or more cam lobes 16 to define a valve cover module, which may reduce complexity and assembly steps at the stage of engine construction. To do so, the cam lobes 16 are aligned with the series of cavities 98 on the second upper side 24 of the cam carrier 20 to position six cam lobes 16, one directly adjacent to opposing sides of the vertical walls 96, in the rows of cavities 98 along the longitudinal cam housings 88. The cam lobes 16 are each positioned vertically within the cavities 98, such as with a support frame, so an interior mating surface 116 of each cam lobe 16 is aligned with the center of the cam bearings. When the interior mating surfaces 116 are aligned with the cam bearings and the cam lobes 16 are radially positioned for appropriate valve timing, the camshafts 18 are inserted sequentially through the cam bearings to couple with each of the cam lobes 16. The interior mating surfaces 116 of the cam lobes 16 may be attached to the camshaft 18 with various techniques, including thermal expansion, welding, and other conceivable techniques generally understood by one having ordinary skill in the art. The cam lobes 16 in the illustrated embodiment have a greater diameter than the cam bearings, such that the cam lobes 16 cannot be attached to the camshaft 18 prior to inserting the camshaft 18 through the cam bearings in this embodiment.

With further reference to the additional embodiment illustrated in FIG. 18, upon inserting the camshafts 18 to a position with on the end portions exposed and all the cam lobes 16 attached thereto, a cam cover is secured over the cam carrier to define a valve cover module that is then mounted to the cylinder head 12. To do so, the peripheral edge 34 of the cam carrier 20 is attached to the cylinder head 12 around the engine valves 14 thereon with a gasket 36 that is disposed between the cam carrier 20 and the cylinder head 12 to provide a fluid seal. Prior to or after attaching the cam carrier 20 to the cylinder head 12, a fuel pump can be attached to the fuel pump pedestal 78. In this embodiment, the fuel pump pedestal 78 is also integrally formed with the carbon fiber composite material of the cam carrier 20 to form a single piece with the cam carrier 20 and the cam caps 58.

With reference again to FIGS. 7, 8, and 17, the tappet bore inserts 56 are operably coupled to the cam carrier 20 within the series of apertures 30. The tappet bore inserts 56 can be operably coupled to the cam carrier 20 within the series of apertures 30 by any of a variety of manners, including, but not limited to, an interference fit between the cam carrier 20 and the bucket tappets 54, by a press fit, by use of an adhesive, or by retention features integral with the bore or attached to the bore. For example, a lip could be added within or adjacent to the bore to positively position and secure the tappet bore insert 56 in place. The cam carrier assembly 10 may be manufactured to tight tolerances. The thickness of the tappet bore inserts 56 is dictated by the space available between the cam carrier 20 within the series of apertures 30 and the bucket tappets 54. In one example, the tappet bore inserts 56 may have a thickness of 1 mm, a weight of about 21.3 grams per tappet bore insert 56, and the tolerance between the bucket tappets 54 and the tappet bore inserts 56 can be 15 μm. It can be difficult to machine a material to such tight tolerances while maintaining long term durability, serviceability, and providing improved lubricity when compared to the material of the cam carrier 20. Further, while examples of the weight and dimensions of the tappet bore inserts 56 are provided, it will be understood by one of skill in the art that the weights and dimensions of the tappet bore inserts 56 will be dependent upon the density and other physical properties of the material used to fabricate the tappet bore inserts 56.

Figure 7:
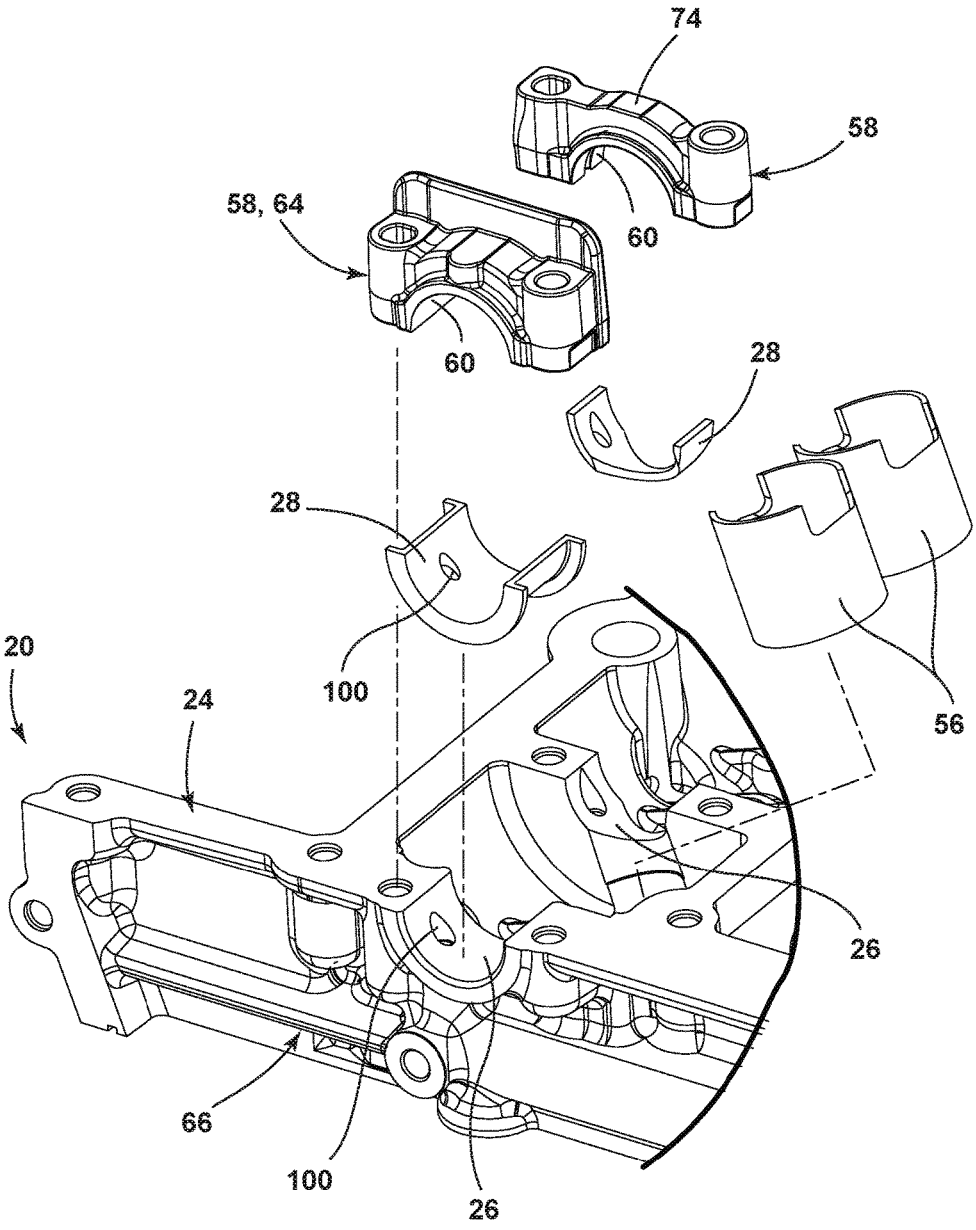
FIG. 7 is an enlarged, exploded partial top perspective view of the cam carrier assembly shown in FIG. 5.
Figure 8:
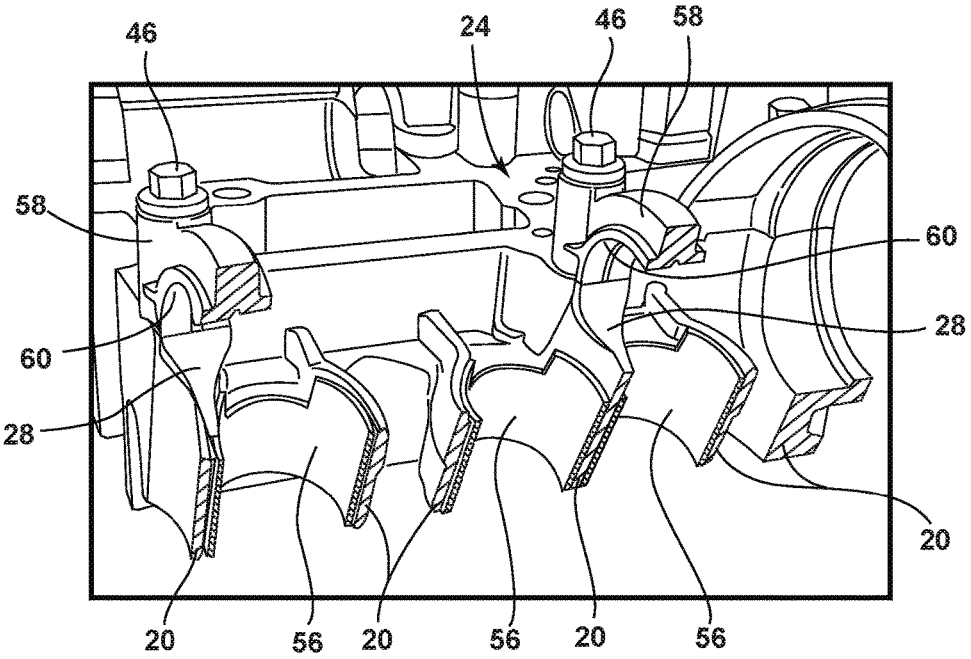
FIG. 8 is a cross-sectional side view of the cam carrier taken at line XV-XV with the camshaft and cylinder head removed.
Figure 9:
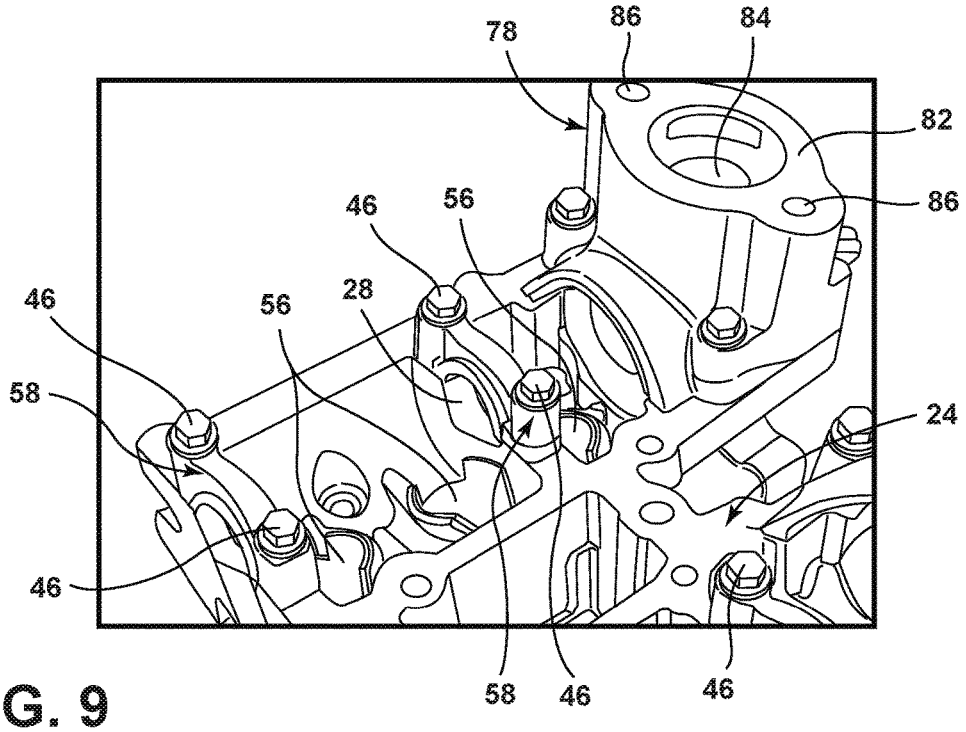
FIG. 9 is a top perspective view of a section of the cam carrier assembly with the camshaft removed.

With further reference to FIGS. 7, 8, and 17, in an embodiment of the cam carrier assembly 10, a clearance of about 100 μm between the cam carrier 20 and the tappet bore inserts 56 is provided. The clearance of about 100 μm permits the use of an adhesive for securing the tappet bore inserts 56 within the series of apertures 30. It will be understand that other clearance values that are greater or less than 100 μm may also be used. In yet another embodiment, a friction fit can be employed to secure the tappet bore inserts 56 within the series of apertures 30. For example, the tappet bore inserts 56 can be fabricated to engage the cam carrier 20 within the series of apertures 30. Installation of the tappet bore inserts 56 in such an example can be achieved by cooling the tappet bore inserts 56 prior to their installation and relying upon the thermal expansion of the tappet bore inserts 56 to increase the diameter of the tappet bore insert 56 such that physical engagement is achieved between the cam carrier 20 and the tappet bore inserts 56; thereby enacting a friction fit between the cam carrier 20 and the tappet bore inserts 56. In still another embodiment, an interference fit can immobilize the tappet bore inserts 56 within the series of apertures 30 of the cam carrier 20. An interference fit can be accomplished by use of lips, edges, other cam carrier assembly 10 components, and the like to retain the tappet bore inserts 56 within the series of apertures 30 of the cam carrier 20. It will be understood by one of skill in the art that other approaches of retaining the tappet bore inserts 56 within the series of apertures 30 of the cam carrier 20 can be employed without departing from the teachings provided herein.

With still further reference to FIGS. 7, 8, and 17, the tappet bore inserts 56 are made of a metal. The metal of the tappet bore inserts 56 can be aluminum or cast iron. Alternatively, an alloy such as an aluminum alloy, a copper alloy, a bronze alloy, brass, or the like can be used to manufacture the tappet bore inserts 56. An example of a bronze alloy, which is in no way intended to be limiting, that can be used as the material for the tappet bore inserts 56 is AMPCO® 18. AMPCO® 18 is made of 10.5% aluminum, 3.5% iron, a maximum of 0.5% of other components, and a balancing percentage of copper. To improve lubricity characteristics further, hard chrome, coated TEFLON®, or non-coated TEFLON® can be applied to the semi-circular bearing inserts 28, tappet bore inserts 56, and semi-circular upper bearing surfaces 60.

With reference again to FIGS. 7, 8, and 17, the surface characteristics of the tappet bore inserts 56 of the present disclosure can be controlled to promote even and full distribution of engine oil. Additionally, the tappet bore inserts 56 can be removed from the cam carrier 20 or replaced. For tappet bore inserts 56 that have been adhered or friction fit to the cam carrier 20, the removal of the tappet bore inserts 56 can be accomplished by machining out the tappet bore inserts 56. For tappet bore inserts 56 that are held in place by an interference fit, the removal of the tappet bore inserts 56 can be accomplished by disassembling the components that provide the interference fit. Old worn tappet bore inserts that are not performing optimally can then be easily repaired or replaced to increase system performance. In an additional embodiment of the present disclosure, the tappet bore inserts 56 can be excluded from the series of apertures 30 in the cam carrier 20 and a coating can be applied to the cam carrier 20 in place of the tappet bore inserts 56.

In yet another embodiment of the present disclosure, the tappet bore inserts 56 can be replaced by net-shape bores. The tappet bore inserts 56 of the present disclosure increase the durability and serviceability of the cam carrier assembly 10 while maintaining a lightweight package. For example, tappet bore inserts 56 that have been worn can be replaced by machining out the bores, for example, thereby facilitating continued use of the majority of the cam carrier assembly 10. By facilitating continued use of the majority of the cam carrier assembly 10 the longevity of the associated engine and vehicle is improved. When longevity is improved, consumers are more likely to purchase a more expensive, increased fuel efficiency vehicle because there is a greater probability of seeing a return on investment.

It will be understood by one having ordinary skill in the art that construction of the disclosed concept and other components is not limited to any specific material. The exemplary embodiments of the concept disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the concept as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structure without departing from the concepts of the present disclosure, and further it is to be understood that such concepts are intended to be covered by the following claims unless these claims by their language expressly state otherwise.

What is claimed is:

1. A cam carrier assembly, comprising:
- a cylinder head having valves;
- a camshaft having lobes;
- a cam carrier constructed from a carbon fiber composite and having a first lower side operably coupled with the cylinder head, and a second upper side having semi-circular lower bearing surfaces with semi-circular bearing inserts operably coupled therewith, the semi-circular bearing inserts supporting the camshaft;
- a series of apertures extending between the first lower side and the second upper side;
- one or more bucket tappets disposed within the series of apertures and operably coupled between the lobes of the camshaft and the valves of the cylinder head; and
- one or more tappet bore inserts operably coupled between the cam carrier and the bucket tappets within the series of apertures.

2. The cam carrier assembly of claim 1, further comprising:
- one or more cam caps coupled with the second upper side of the cam carrier, each having a semi-circular upper bearing surface for directly engaging the camshaft, the cam caps made of the same material as the bearing inserts.

3. The cam carrier assembly of claim 1, further comprising:
- a gasket operably coupled to a peripheral edge of the first lower side of the cam carrier and configured to sealably engage the cam carrier to the cylinder head.

4. The cam carrier assembly of claim 1, wherein the carbon fiber composite includes a resin and a fiber configured for injection molding the cam carrier, and wherein the cylinder head includes an aluminum alloy.

5. The cam carrier assembly of claim 1, further comprising:
- one or more threaded fasteners that extend through the cam carrier and into threaded engagement with corresponding fastening holes in the cylinder head.

6. The cam carrier assembly of claim 5, wherein the one or more threaded fasteners is at least equal to the number of cylinders present in the cylinder head.

7. The cam carrier assembly of claim 1, wherein the tappet bore inserts are made of a copper alloy.

8. The cam carrier assembly of claim 7, wherein the copper alloy is AMPCO® 18.

9. A cam carrier, comprising:
- a body formed from a single piece of carbon fiber composite;
- a first side engaging a cylinder head;
- a second side with semi-circular lower bearing surfaces for supporting a camshaft; and
- a series of apertures extending between the first side and second side in linear alignment with the semi-circular lower bearing surfaces such that the camshaft operably couples with valves on the cylinder head.

10. The cam carrier of claim 9, wherein the carbon fiber composite includes thermal expansion properties that differ from the thermal expansion properties of the cylinder head by at least 25%.

11. The cam carrier of claim 9, wherein the carbon fiber composite includes a thermosetting resin and a chopped carbon fiber combined to support forces acting on the camshaft.

12. The cam carrier of claim 9, further comprising:

one or more cam caps fastened to the second side of the cam carrier with fasteners operably coupled to the cam carrier on opposing sides of the camshaft, each cam cap having a semi-circular upper bearing surface for directly engaging the camshaft.

13. The cam carrier of claim 9, wherein the first side of the cam carrier includes a locating member protruding downward for engaging a corresponding locating aperture on the cylinder head.

14. The cam carrier of claim 9, wherein the single piece of carbon fiber composite includes oil feed channels formed integrally therein and extending to a circumference of the semi-circular lower bearing surfaces for providing lubrication to the camshaft.

15. The cam carrier of claim 9, further comprising:

a fuel pump pedestal formed separately from the cam carrier and fastened to the second side of the cam carrier with threaded fasteners.

16. A cam carrier assembly, comprising:

a body made of a material lighter than aluminum and having:

a first lower side operably coupled with a cylinder head, and a second upper side having semi-circular lower bearing surfaces with semi-circular bearing inserts operably coupled therewith, the semi-circular bearing inserts supporting a camshaft;

a series of apertures extending between the first lower side and second upper side; and lobes of the camshaft operably coupling with valves of the cylinder head through the series of apertures extending between the first lower side and second upper side.

17. The cam carrier assembly of claim 16, wherein the material lighter than aluminum is a thermosetting resin.

18. The cam carrier assembly of claim 16, further comprising:

one or more cam caps operably coupled with the second upper side of the cam carrier, each having a semi-circular upper bearing surface for directly engaging the camshaft.

19. The cam carrier assembly of claim 16, further comprising:

a gasket attached around a peripheral edge of the first side of the cam carrier and configured to sealably engage the cam carrier to the cylinder head.

20. The cam carrier assembly of claim 16, further comprising:

a fuel pump pedestal operably coupled with the second side of the cam carrier for supporting a fuel pump.

* * * * *